US009655401B2

(12) United States Patent
Colpack

(10) Patent No.: US 9,655,401 B2
(45) Date of Patent: May 23, 2017

(54) POLYMER SHOE

(71) Applicant: ARTHUR JOSEPH FOR SURELL, LLC, Troy, NH (US)

(72) Inventor: Arthur J Colpack, Boston, MA (US)

(73) Assignee: Arthur Joseph for Surell, LLC., Troy, NH (US)

( * ) Notice: Subject to any disclaimer, the term of this patent is extended or adjusted under 35 U.S.C. 154(b) by 260 days.

(21) Appl. No.: 14/449,400

(22) Filed: Aug. 1, 2014

(65) Prior Publication Data

US 2015/0033582 A1 Feb. 5, 2015

Related U.S. Application Data

(60) Provisional application No. 61/861,566, filed on Aug. 2, 2013.

(51) Int. Cl.

| | |
|---|---|
| ***A43B 1/10*** | (2006.01) |
| ***A43B 13/04*** | (2006.01) |
| ***A43B 13/14*** | (2006.01) |
| ***A43B 23/02*** | (2006.01) |
| ***A43C 11/00*** | (2006.01) |

(52) U.S. Cl.

CPC ..... *A43B 13/04* (2013.01); *A43B 1/10* (2013.01); *A43B 13/145* (2013.01); *A43B 23/0215* (2013.01); *A43C 11/00* (2013.01)

(58) Field of Classification Search

CPC ..... A43B 13/04; A43B 13/145; A43B 13/143; A43B 3/24; A43B 3/16; A43B 3/18; A43B 3/10; A43B 3/01; A43B 1/10; A43B 11/00; A43B 23/02154

USPC ..... 36/103, 7.1 R, 142, 102; 2/239

See application file for complete search history.

(56) References Cited

U.S. PATENT DOCUMENTS

| | | | | | |
|---|---|---|---|---|---|
| 461,310 | A | * | 10/1891 | Brittain | A43B 3/16 36/7.3 |
| 1,465,180 | A | * | 8/1923 | Rowe | A43B 3/18 24/301 |
| 2,068,238 | A | * | 1/1937 | Malm | A43B 3/16 249/160 |
| 2,435,976 | A | * | 2/1948 | Monagin | A43B 13/143 36/171 |
| D149,685 | S | * | 5/1948 | Sandler | D2/935 |
| 2,627,126 | A | * | 2/1953 | France | A43B 3/163 36/51 |
| 3,148,378 | A | * | 9/1964 | Tibbitts | A41B 11/00 2/239 |

(Continued)

OTHER PUBLICATIONS

Helene, "Review: Payless Claire Scrunch Flat", Sep. 27, 2012, Bon Vivant and a Budget, 3 pages.*

(Continued)

*Primary Examiner* — Khoa Huynh
*Assistant Examiner* — Katharine Gracz
(74) *Attorney, Agent, or Firm* — Maine Cernota & Rardin

(57) ABSTRACT

An elastomeric shoe is provided that comprises a curved sole, an upper portion thereof having a vamp and curved top line. The upper portion and curved sole are molded from an elastomeric material, allowing the curved top line to stretch in tension, enabling the shoe's sole to achieve a substantially planar orientation when placed upon a wearer's foot to both enhance user comfort and provide better adherence to a wearer's foot without the need for an unsightly, elasticized, gathered topline.

14 Claims, 3 Drawing Sheets

(56) References Cited

U.S. PATENT DOCUMENTS 3,313,047 A * 4/1967 Svien ..... A43B 5/18 36/135
3,643,352 A * 2/1972 Adair ..... A43B 5/18 36/7.3
4,434,565 A * 3/1984 Haley ..... A43C 15/06 36/59 R
4,779,360 A * 10/1988 Bible ..... A43B 3/16 36/59 R
5,315,767 A * 5/1994 Bradbury ..... A43B 3/16 36/135
6,766,539 B1 * 7/2004 Huber ..... A41B 11/10 2/239
D630,829 S * 1/2011 Weisner ..... D2/896
7,966,748 B2 * 6/2011 Votolato ..... A43C 15/02 36/100
8,453,355 B2 * 6/2013 Kay ..... A43B 5/185 36/135
2003/0070319 A1 * 4/2003 Minden ..... A43B 3/108 36/8.3
2007/0144039 A1 * 6/2007 Fliri ..... A43B 1/10 36/94
2011/0035964 A1 * 2/2011 Gallagher ..... A43B 5/185 36/131
2011/0185593 A1 * 8/2011 Ramos ..... A43B 13/145 36/103
2012/0227281 A1 * 9/2012 Young ..... A43B 19/00 36/10
2014/0047740 A1 * 2/2014 Tucker ..... A43B 13/145 36/103

OTHER PUBLICATIONS

Kathy, "Payless: DexFlex Women's Clair Scrunch Flat (Also Kissell Flats Dupe)", Oct. 15, 2012, Blogspot, 3 pages.*
"Ashlee Simpson in Bloch Flats, Ramones T-shirt, and Chanel Bag", Oct. 18, 2010, Upscale Hype, 4 pages.*

* cited by examiner

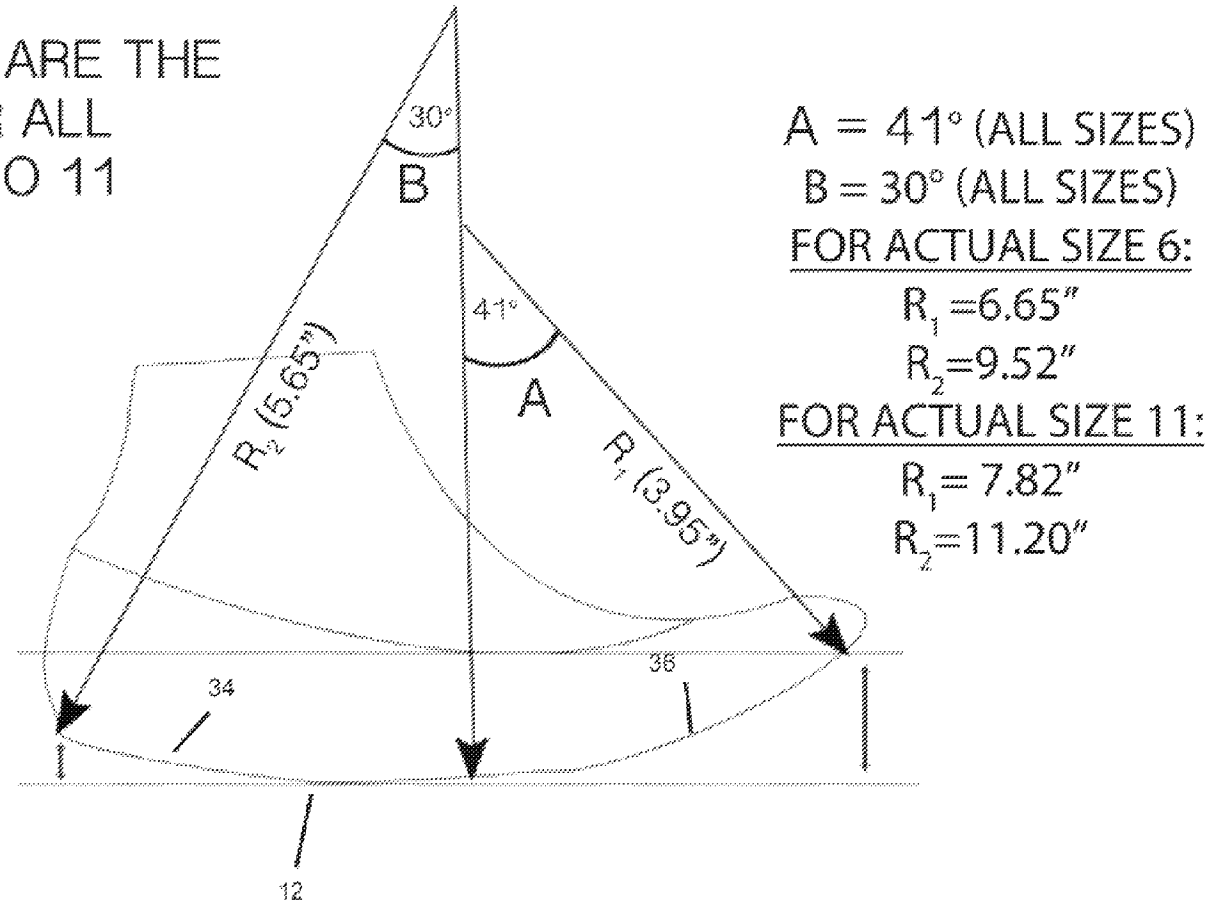
FIG. 1-A

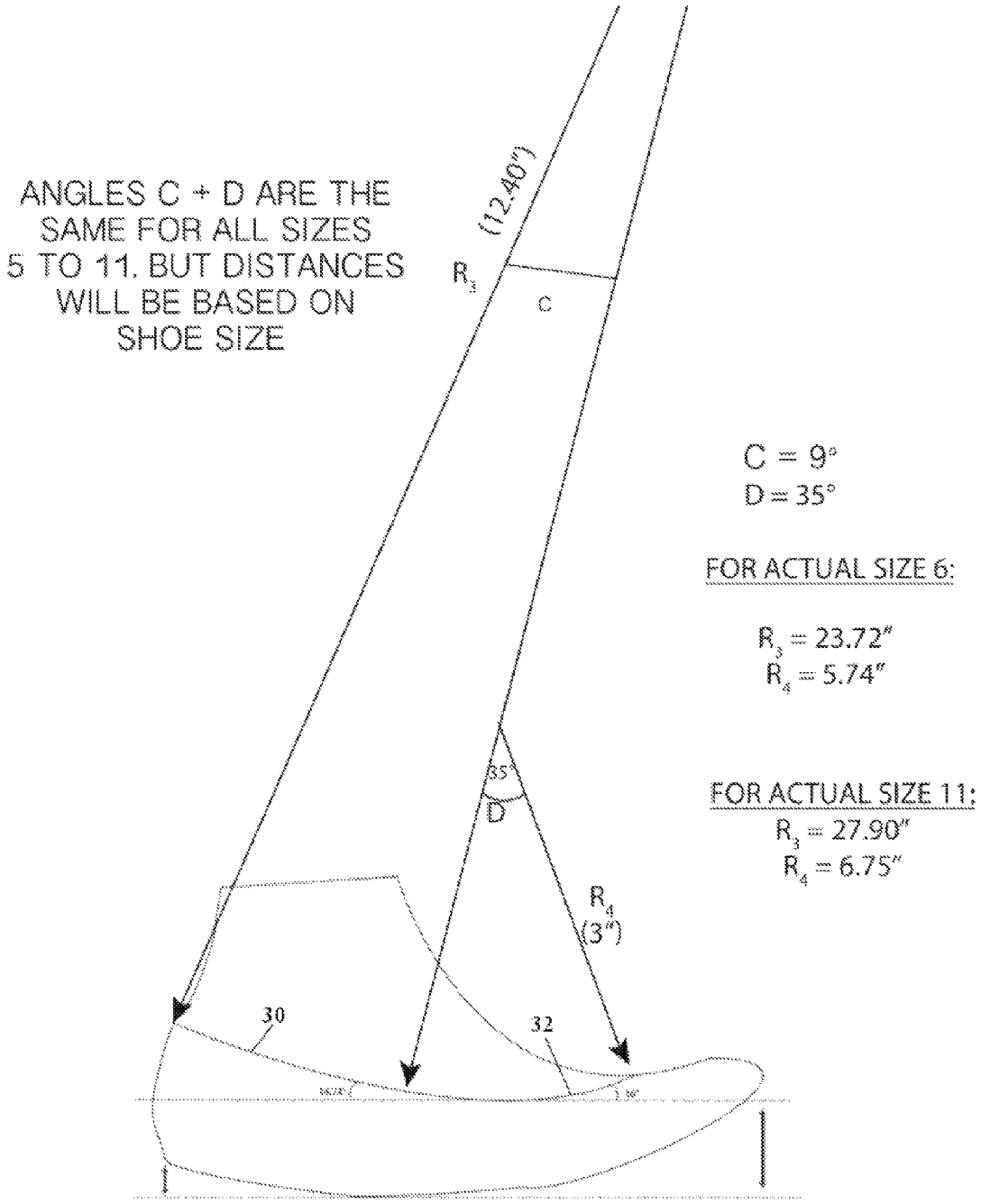
* THIS DRAWING IS 52.2% OF SIZE 6 ACTUAL SIZE
FIG. 1-B

POLYMER SHOE

RELATED APPLICATIONS

This application claims the benefit of U.S. Provisional Application No. 61/861,566, filed Aug. 2, 2013. This application is herein incorporated by reference in its entirety for all purposes.

FIELD OF THE INVENTION

The invention relates to shoes, and more particularly, to an elastomeric shoe having a curved sole.

BACKGROUND OF THE INVENTION

Ballet flats, also known as ballet shoes, ballerina shoes, ballerina flats, dolly shoes and skimmers, may generally be described as flat women's shoes with substantially open tops. Despite their name, they are frequently worn by those not engaged in the practice or performance of ballet for aesthetic reasons as well as for their portability, a trend which has increased in recent years. At least a part of this rise in popularity is due to their relatively small size and weight.

Traditional ballet flats are typically provided with elasticized gathered top lines to allow the shoe to securely conform to the shape of the wearer's foot. This feature is especially necessary for traditional ballet shoes because of the materials used (typically leather, which does not have substantial elastic properties) and the vigorous use to which they are designed to accommodate. Although, for traditional ballet shoes, this feature is necessary and desirable, when these shoes are worn for reasons of appearance and portability, this gathered top line creates extra bulk and may be considered unsightly. Because of the aesthetic problems created by elasticized gathered top lines, some ballet flats designed to appeal to those concerned primarily with appearance and portability have foregone this portion of the shoe. Due to these shoe's comparatively open uppers, they are less secure than the traditional variety and are liable to fall off of the user's foot during use.

What is needed, therefore, is an aesthetically pleasing, functional ballet flat style shoe that is capable of comfortably remaining on a wearer's foot during all manner of use while minimizing or eliminating the bulk traditionally associated with the elements present in a ballet flat designed to ensure such a secure fit.

SUMMARY OF THE INVENTION

One embodiment of the present invention provides an elastomeric shoe, the shoe comprising a sole defining an upwardly directed longitudinal arc, a stretchable upper portion of the shoe comprising a vamp and curved top line, the upper portion of the shoe and the curved sole being made of an elastomeric material and the curved top line being configured to stretch in tension, allowing the sole to achieve a substantially planar orientation when placed upon a wearer's foot, thereby securely holding the shoe to the foot.

Another embodiment of the present invention provides such a shoe wherein the elastomeric material is selected from the group consisting of natural polymers, synthetic polymers, and polymer blends.

A further embodiment of the present invention provides such a shoe wherein the elastomeric material is natural. rubber.

Yet another embodiment of the present invention provides such a shoe wherein the curved topline is configured as a compound arc.

A yet further embodiment of the present invention provides such a shoe wherein the topline compound arc comprises a first topline arc and a second topline arc.

Still another embodiment of the present invention provides such a shoe wherein the angle between a topline curve transition point, positioned between the first topline arc and the second topline arc, and a rear-most portion of the second topline arc is between approximately 12° and 18° degrees, A still further embodiment of the present invention provides such a shoe wherein the angle between a topline curve transition point, positioned between the first topline arc and the second topline arc, and a rear-most portion of the second topline arc is approximately 14.74 degrees.

Even another embodiment of the present invention provides such a shoe wherein the angle between a topline curve transition point, positioned between the first topline arc and the second topline arc, and a front-most portion of the first topline arc is between approximately 13° and 19° degrees.

An even yet another embodiment of the present invention provides such a shoe wherein the angle between a topline curve transition point, positioned between the first topline arc and the second topline arc, and a front-most portion of the first topline arc is approximately 16 degrees.

An even yet still another embodiment provides such a shoe wherein the first topline arc defines an angle of between approximately 32° and 38°, the angular measurement taken from the center of a first topline circle, having its center located on a topline reference axis, which is normal to a plane tangential to a topline curve transition point between the first topline arc and the second topline arc, the reference axis positioned at the same longitudinal position as the topline curve transition point and substantially laterally centered within the shoe, to a point of intersection between the circumference of the first topline circle and the front-most portion of the first topline arc, wherein the second topline arc defines an angle of between approximately 6° and 12°, the angular measurement taken from the center of a second topline circle, having its center located. on the topline reference axis, to a point of intersection between the circumference of the second topline circle and the rear-most portion of the second topline arc and wherein the angles of the first topline arc and the second topline arc, with respect to the reference axis, are kept constant across various shoe sizes, but the radii of the circles from which the arcs are taken are adjusted substantially in accordance with the following equations, where "x" indicates women's US shoe size:

$$\text{Radius Length in mm} = 5.1308x + 115.0100 \qquad \text{First Topline Arc}$$

$$\text{Radius Length in mm} = 21.2340x + 475.0900 \qquad \text{Second Topline Arc}$$

An even further embodiment provides such a shoe wherein the first topline arc defines an angle of approximately 35°, the angular measurement taken from the center of a first topline circle, having its center located on a topline reference axis, which is normal to a plane tangential to a topline curve transition point between the first topline arc and the second topline arc, the reference axis positioned at the same longitudinal position as the topline curve transition point and substantially laterally centered within the shoe, to a point of intersection between the circumference of the first topline circle and the front-most portion of the first topline arc, wherein the second topline arc defines an angle of approximately 9°, the angular measurement taken from the center of a second topline circle, having its center located on the topline reference axis, to a point of intersection between the circumference of the second topline circle and the rear-most portion. of the second topline arc and wherein the angles of the first topline arc and the second topline arc, with respect to the reference axis, are kept constant across various shoe sizes, but the radii of the circles from which the arcs are taken are adjusted substantially in accordance with the following equations, where "x" indicates women's US shoe size:

Radius Length in mm=5.1308$x$+115.0100 First Topline Arc

Radius Length in mm=21.2340$x$+475.090 Second Topline Arc

A still even another embodiment of the present invention provides such a shoe wherein the curved sole is configured as a compound arc.

A still even further embodiment of the present invention provides such a shoe wherein the sole compound arc comprises a first sole arc and a second sole arc.

A still even yet further embodiment of the present invention provides such a shoe wherein the first sole arc defines an angle of between approximately 38° and 44°, the angular measurement taken from the center of a first sole circle, having its center located on a sole reference axis, which is normal to a plane tangential to a sole curve transition point between the first sole arc and the second sole arc, the reference axis positioned at the same longitudinal position as the sole curve transition point and substantially laterally centered within the shoe, to a point of intersection between the circumference of the first sole circle and the front-most portion of the first sole arc, wherein the second sole arc defines an angle of between approximately 27°-33°, the angular measurement taken from the center of a second sole circle, having its center located on the sole reference axis, to a point of intersection between the circumference of the second sole circle and the rear-most portion of the second sole arc and wherein the angles of the first sole arc and the second sole arc, with respect to the reference axis, are kept constant across various shoe sizes, but the radii of the circles from which the arcs are taken are adjusted substantially in accordance with the following equations, where "x" indicates women's US shoe size:

Radius Length in mm=5.9436$x$+133.2500 First Sole Arc

Radius Length in mm=8.5344$x$+190.6000 Second Sole Arc

Still yet another embodiment of the present invention provides such a shoe wherein the first sole arc defines an angle of approximately 41°, the angular measurement taken from the center of a first sole circle, having its center located on a sole reference axis, which is normal to a plane tangential to a sole curve transition point between the first sole arc and the second sole arc, the reference axis positioned at the same longitudinal position as the sole curve transition point and substantially laterally centered within the shoe, to a point of intersection between the circumference of the first sole circle and the front-most portion of the first sole arc, wherein the second sole arc defines an angle of approximately 30°, the angular measurement taken from the center of a second sole circle, having its center located on the sole reference axis, to a point of intersection between the circumference of the second sole circle and the rear-most portion of the second sole arc and wherein the angles of the first sole arc and the second sole arc, with respect to the reference axis, are kept constant across various shoe sizes, but the radii of the circles from which the arcs are taken are adjusted substantially in accordance with the following equations, where "x" indicates women's US shoe size:

Radius Length in mm=5.9436$x$+133.2500 First Sole Arc

Radius Length in mm=8.5344$x$+190.6000 Second Sole Arc

A still yet further embodiment of the present invention provides such a shoe wherein the lowest point of the sole is longitudinally offset from the lowest point of the topline.

Even yet another embodiment of the present invention provides such a shoe wherein the lowest point of the topline is vertically separated by between approximately 20 mm and 43 mm from the lowest point of the curved sole.

An even yet further embodiment of the present invention provides such a shoe wherein the curved sole is a split sole.

One embodiment of the present invention provides an elastomeric shoe, the shoe comprising: a sole defining an upwardly directed longitudinal arc, a stretchable upper portion of the shoe comprising a vamp and curved top line, the upper portion of the shoe and the curved sole being made of an elastomeric material, the curved top line being configured to stretch in tension, allowing the sole to achieve a substantially planar orientation when placed upon a wearer's foot, thereby securely holding the shoe to the foot, wherein the curved topline is configured as a compound arc, the topline compound arc comprising a first topline arc and a second topline arc, wherein the first topline arc defines an angle of between approximately 32° and 38°, the angular measurement taken from the center of a first topline having its center located on a topline reference axis, which is normal to a plane tangential to a topline curve transition point between the first topline arc and the second topline arc, the reference axis positioned at the same longitudinal position as the topline curve transition point and substantially laterally centered within the shoe, to a point of intersection between the circumference of the first topline circle and the front-most portion of the first topline arc, wherein the second topline arc defines an angle of between approximately 6° and 12°, the angular measurement taken from the center of a second topline circle, having its center located on the topline reference axis, to a point of intersection between the circumference of the second topline circle and the rear-most portion of the second topline arc, wherein the first sole arc defines an angle of between approximately 38° and 44°, the angular measurement taken from the center of a first sole circle, having its center located on a sole reference axis, which. is normal to a plane tangential to a sole curve transition point between the first sole arc and the second sole arc, the reference axis positioned at the same longitudinal position as the sole curve transition point and substantially laterally centered within the shoe, to a point of intersection between the circumference of the first sole circle and the front-most portion of the first sole arc, wherein the second sole arc defines an angle of between approximately 27° and 33°, the angular measurement taken from the center of a second sole circle, having its center located on the sole reference axis, to a point of intersection between the circumference of the second sole circle and the rear-most portion of the second sole arc and wherein the angles of the first topline arc, the second topline arc, the first sole arc and the second. sole arc, with respect to the reference axis, are kept constant across various shoe sizes, but the radii of the circles from which the arcs are taken are adjusted substantially in accordance with the following equations, where x indicates women's US shoe size:

Radius Length in mm=5.1308$x$+115.0100 First Topline Arc

Radius Length in mm=21.2340$x$+475.0900 Second Topline Arc

Radius Length in mm=5.9436$x$+133.2500 First Sole Arc

Radius Length in mm=8.5344$x$+190.6000 Second Sole Arc

One embodiment of the present invention provides a process for manufacturing an elastomeric shoe, the shoe comprising: a sole defining an upwardly directed longitudinal arc, a stretchable upper portion of the shoe comprising a vamp and curved top line, the upper portion of the shoe and the curved sole being made of an elastomeric material and the curved top line being configured to stretch in tension, allowing the sole to achieve a substantially planar orientation when placed upon a wearer's foot, thereby securely holding the shoe to the foot, the process comprising molding natural rubber around a last configured to provide the desired proportions and angles of curvature for the sole and the topline.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

FIG. 1A is a side elevation view illustrating a shoe configured in accordance with one embodiment of the present invention showing the configuration of the curvature of the sole.

FIG. 1B is a side elevation view illustrating a shoe configured in accordance with one embodiment of the present invention showing the configuration of the curvature of the top line.

DETAILED DESCRIPTION

Figure 2:
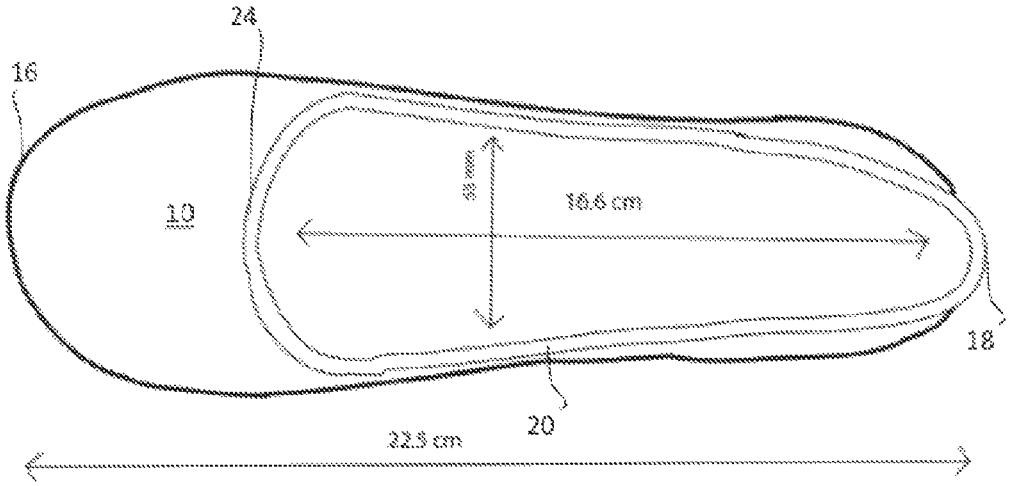
FIG. 2 is a top plan view illustrating a shoe configured in accordance with one embodiment of the present invention.

One embodiment of the present invention, as illustrated in FIGS. 1A and 1B, provides an elastomeric shoe 10 wherein the curvature of the top line 20 and sole 12 each comprise compound arcs 30, 32, 34, 36. For various sizes, the angle of the arcs C, D, A and B, respectively, is kept constant, but with different size shoes, the radii of the circles from which the arcs are taken will vary formulaically. The circles from which radii are taken are centered on a reference axis that extends normally from the point of transition between the compound curves. For the topline arcs, R3 and R4, the point of transition between compound curves 30 and 32 is used as the vertical starting point for the reference axis, while for the sole arcs, R1 and R2, the point of transition between compound curved 34 and 36 is used. Although the reference axis is angled as described, it is assumed that the angles will be measured using a profile view of the shoe 10 or that each reference axis and corresponding arcs will occupy the same two-dimensional plane centrally located within the width of the shoe.

In one embodiment, the curvature of the sole, as in FIG. 1A comprises a compound ark of two angles, angle A and angle B, which remain constant between sizes of shoes, but with radii, R1 and R2, respectively, of the two arcs being changed between sizes according to Table 1. In one embodiment, the angles may be approximately 41° for angle A, and 30° for angle B, but may, in other embodiments, be between approximately 38° and 44° for angle A and between approximately 38° and 44° for angle B.

Similarly, as illustrated in FIG. 1B, the angles of the top line will be 35° for angle D, and 9° for angle C, regardless of shoe size, although in other embodiments angle D may be between approximately 32° and 38°, while angle C may be between approximately 6° and 12°. As noted, for various sizes, the radii of the two topline arks, R3 and R4, respectively, and two sole arks will change, in embodiments, according to Table 1, which shows the radii rounded to the nearest single significant digit.

TABLE 1

(length in mm)

| Shoe Size | R1 | R2 | R3 | R4 |
|---|---|---|---|---|
| 6 | 168.9 | 241.8 | 602.5 | 145.8 |
| 7 | 174.9 | 250.3 | 623.7 | 150.9 |
| 8 | 180.8 | 258.9 | 645.0 | 156.1 |
| 9 | 186.7 | 267.4 | 666.2 | 161.2 |
| 10 | 192.7 | 275.9 | 687.4 | 166.3 |
| 11 | 198.6 | 284.5 | 708.7 | 171.4 |

The radii in mm (i.e. R1, R2, R3 and R4) of Table 1, for a particular size of shoe, in embodiments, may be readily calculated by the following linear equations, wherein the variable "x" is shoe size according to standard women's US sizes:

Radius Length in mm=5.9436$x$+133.2500 First Sole Arc ($R1$)

Radius Length in mm=8.5344$x$+190.6000 Second Sole Arc ($R2$)

Radius Length in mm=5.1308$x$+115.0100 First Topline Arc

Radius Length in mm=21.2340$x$+475.0900 Second Topline Arc

Figure 3:
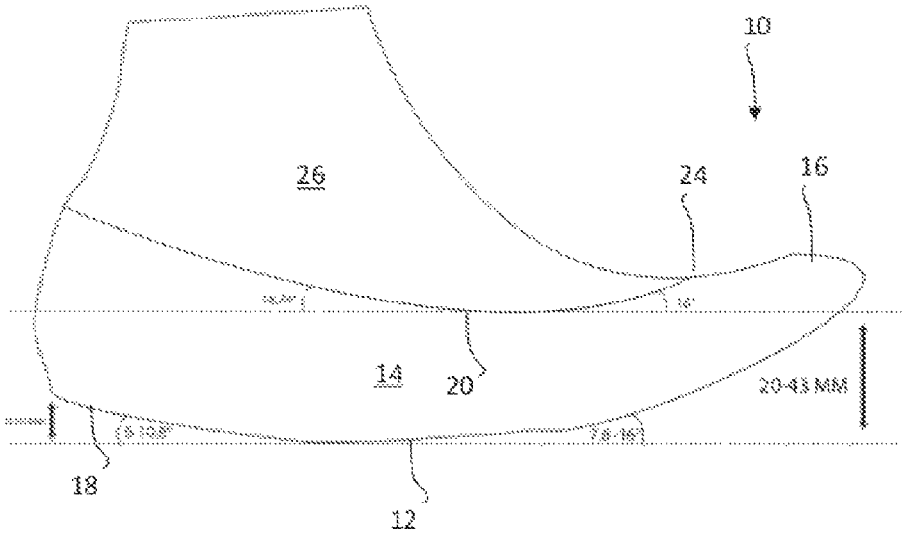
FIG. 3 is a side elevation view illustrating a shoe configured in accordance with one embodiment of the present invention.

One embodiment of the present invention, as illustrated in FIGS. 2 and 3, provides an elastomeric shoe 10 wherein the sole 12 is configured in an upwardly directed longitudinal arc, and the upper portion of the shoe 14 is configured to stretch, without requiring elastic toplines, to allow for insertion of a wearer's foot.

In one embodiment of the present invention, the elastomeric shoe 10 may be made of natural rubber, a synthetic polymer or a blend of polymers, such polymers being natural or synthetic, having similar elastic properties to natural rubber. Such materials may or may not be vulcanized (AKA cross-linked), dependent upon their original properties and chemistry. Polymers used may be thermoplastics or thermosets.

One embodiment of the present invention, as illustrated in FIG. 3, is described in the context of a shoe that is a woman's size 6-6.5. The arc of the sole 12, when not worn by the wearer, comprises a curve of between 7.8 and 16 degrees at the toe 16 and 0-10.8 degrees at the heel 18, in embodiments, as measured from a substantially flat surface with such shoe resting on the substantially flat surface. While precise angles and curvatures will vary depending on the size of the shoe, one skilled in the art would readily comprehend the necessary adjustments to maintain the desired aesthetic and functional benefits of such a design.

In one embodiment, the topline of the shoe 20 is configured such that when stretched over a wearer's foot, it resembles a traditional ballet flat or other similar flat, low-cut, shoe. in such an embodiment, the angle between a point at which the curvature of the shoe's topline 20 begins to ascend to the topmost portion of the heel 18 may be between approximately 12° and 18° degrees, but in other embodiments it is 14.74 degrees, while the angle between the same point of the topline 20 to the rearmost portion of the vamp 24, where the front-most topline curve ends at its most forward position, is between approximately 13° and 19° degrees, while in other embodiments, as shown in FIGS. 1-B and 3, this angle may be approximately 16°.

In one such embodiment, the lowest point of the sole is offset from the lowest point in the topline. In such an embodiment of the present invention, the lowest point of the topline 20 may be vertically separated between approximately 20 and 43 mm from the lowest point of the curved sole 12.

In one embodiment, the polymer shoe is manufactured by molding around a last 26 that is configured to provide the desired proportion and angles of curvature for the sole 12 and topline 20.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

What is claimed is:

1. An elastomeric shoe having a substantially open top portion, the shoe comprising:

a sole defining an upwardly directed longitudinal arc; and a stretchable upper portion fixed to said sole comprising an elastic top line configured to be free of wrinkles in an unworn state;

wherein:

at least said upper portion is made of an elastomeric material and is configured to stretch, during use, to conform to a foot of a wearer and, upon removal, to return to its original dimensions; and said elastic top line is configured to stretch substantially in tension, allowing said sole to achieve a substantially planar orientation when placed upon the wearer's foot, and conform to a top portion of the wearer's foot, thereby securely holding said shoe to said foot;

wherein said elastic topline is configured as a compound arc; said topline arch comprises a first topline arc and a second topline arc;

wherein said first topline arc defines an angle of between 32° and 38°, said angle being measured from a center of a first topline circle, having its center located on a topline reference axis, which is normal to a plane tangential to a topline curve transition point between said first topline arc and said second topline arc, said reference axis positioned at the same longitudinal position as said topline curve transition point and substantially laterally centered within said shoe, to a point of intersection between a circumference of said first topline circle and a front-most portion of said first topline arc;

wherein said second topline arc defines an angle of between 6° and 12°, said angle being measured from a center of a second topline circle, having its center located on the topline reference axis, to a point of intersection between a circumference of said second topline circle and a rear-most portion of said second topline arc; and wherein the angles of said first topline arc and said second topline arc, with respect to said reference axis, are kept constant across various shoe sizes, but the radii of the circles from which said arcs are taken are adjusted substantially in accordance with the following equations, where "x" indicates women's US shoe size:

Radius Length in mm=5.1308$x$+115.0100 First Topline Arc

Radius Length in mm=21.2340$x$+475.0900 Second Topline Arc.

2. The shoe of claim 1 wherein said elastomeric material is selected from the group consisting of natural polymers, synthetic polymers, and polymer blends.

3. The shoe of claim 1 wherein said elastomeric material is natural rubber.

4. The shoe according to claim 1 wherein an angle between a topline curve transition point, positioned between said first topline arc and said second topline arc, and a rear-most portion of said second topline arc is between 12° and 18°.

5. The shoe according to claim 1 wherein an angle between a topline curve transition point, positioned between said first topline arc and said second topline arc, and a rear-most portion of said second topline arc is approximately 14.74°.

6. The shoe according to claim 1 wherein an angle between a topline curve transition point, positioned between said first topline arc and said second topline arc, and a front-most portion of said first topline arc is between 13° and 19°.

7. The shoe according to claim 1 wherein an angle between a topline curve transition point, positioned between said first topline arc and said second topline arc, and a front-most portion of said first topline arc is approximately 16 degrees.

8. The shoe of claim 1 wherein said first topline arc defines an angle of approximately 35°, said angle being measured from a center of a first topline circle, having its center located on a topline reference axis, which is normal to a plane tangential to a topline curve transition point between said first topline arc and said second topline arc, said reference axis positioned at the same longitudinal position as said topline curve transition point and substantially laterally centered within said shoe, to a point of intersection between a circumference of said first topline circle and a front-most portion of said first topline arc;

wherein said second topline arc defines an angle of approximately 9°, said angle being measured from a center of a second topline circle, having its center located on the topline reference axis, to a point of intersection between a circumference of said second topline circle and a rear-most portion of said second topline arc; and wherein the angles of said first topline arc and said second topline arc, with respect to said reference axis, are kept constant across various shoe sizes, but the radii of the circles from which said arcs are taken are adjusted substantially in accordance with the following equations, where "x" indicates women's US shoe size:

Radius Length in mm=5.1308$x$+115.0100 First Topline Arc

Radius Name Length in mm= 21.2340$x$+475.0900 Second Topline Arc.

9. An elastomeric shoe having a substantially open top portion, the shoe comprising:

a sole defining an upwardly directed longitudinal arc; and a stretchable upper portion fixed to said sole comprising an elastic to line configured to be free of wrinkles in an unworn state;

wherein:

at least said upper portion is made of an elastomeric material and is configured to stretch, during use, to conform to a foot of a wearer and, upon removal, to return to its original dimensions; and said elastic to line is configured to stretch substantially in tension, allowing said sole to achieve a substantially planar orientation when placed upon the wearer's foot, and conform to a top portion of the wearer's foot, thereby securely holding said shoe to said foot;

wherein said curved sole is configured as a compound arc, said sole compound arc comprises a first sole arc and a second sole arc wherein said first sole arc defines an angle of between 38° and 44°, said angle being measured from a center of a first sole circle, having its center located on a sole reference axis, which is normal to a plane tangential to a sole curve transition point between said first sole arc and said second sole arc, said reference axis positioned at the same longitudinal position as said sole curve transition point and substantially laterally centered within said shoe, to a point of intersection between a circumference of said first sole circle and a front-most portion of said first sole arc;

wherein said second sole arc defines an angle of between 27° and 33°, said angle being measured from a center of a second sole circle, having its center located on the sole reference axis, to a point of intersection between a circumference of said second sole circle and a rear-most portion of said second sole arc; and wherein the angles of said first sole arc and said second sole arc, with respect to said reference axis, are kept constant across various shoe sizes, but the radii of the circles from which said arcs are taken are adjusted substantially in accordance with the following equations, where "x" indicates women's US shoe size:

| | |
|---|---|
| Radius Length in mm=5.9436$x$+133.2500 | First Sole Arc |
| Radius Length in mm=8.5344$x$+190.6000 | Second Sole Arc. |

10. The shoe of claim 1 wherein a lowest point of said sole is longitudinally offset from a lowest point of said topline.

11. The shoe of claim 1 wherein the lowest point of said topline is vertically separated by between 20 mm and 43 mm from the lowest point of said curved sole.

12. The shoe of claim 1 wherein said curved sole is a split sole.

13. An elastomeric shoe having a substantially open top portion, the shoe comprising:

a sole defining an upwardly directed longitudinal arc; and a stretchable upper portion fixed to said sole comprising an top line consisting of an elastomeric material configured to be free of wrinkles in an unworn state;

wherein:

at least said upper portion is made of an elastomeric material and is configured to stretch, during use, to conform to a foot of a wearer and, upon removal, to return to its original dimensions;

said elastic top line is configured to stretch substantially in tension, allowing said sole to achieve a substantially planar orientation when placed upon the wearer's foot, and conform to a top portion of the wearer's foot, thereby securely holding said shoe to said foot;

wherein said elastic topline is configured as a compound arc, said topline compound arc comprising a first topline arc and a second topline arc;

wherein said first topline arc defines an angle of between 32° and 38°, said angle being measured from a center of a first topline circle, having its center located on a topline reference axis, which is normal to a plane tangential to a topline curve transition point between said first topline arc and said second topline arc, said reference axis positioned at the same longitudinal position as said topline curve transition point and substantially laterally centered within said shoe, to a point of intersection between a circumference of said first topline circle and a front-most portion of said first topline arc;

wherein said second topline arc defines an angle of between 6° and 12°, said angle being measured from a center of a second topline circle, having its center located on the topline reference axis, to a point of intersection between a circumference of said second topline circle and a rear-most portion of said second topline arc;

wherein a first sole arc defines an angle of between 38° and 44°, said angle being measured from a center of a first sole circle, having its center located on a sole reference axis, which is normal to a plane tangential to a sole curve transition point between said first sole arc and said second sole arc, said reference axis positioned at the same longitudinal position as said sole curve transition point and substantially laterally centered within said shoe, to a point of intersection between a circumference of said first sole circle and a front-most portion of said first sole arc;

wherein a second sole arc defines an angle of between 27° and 33°, said angle being measured from a center of a second sole circle, having its center located on the sole reference axis, to a point of intersection between a circumference of said second sole circle and a rear-most portion of said second sole arc; and wherein the angles of said first topline arc, said second topline arc, said first sole arc and said second sole arc, with respect to said reference axis, are kept constant across various shoe sizes, but the radii of the circles from which said arcs are taken are adjusted substantially in accordance with the following equations, where x indicates women's US shoe size:

| | |
|---|---|
| Radius Length in mm=5.1308$x$+115.0100 | First Topline Arc |
| Radius Length in mm=21.2340$x$+475.0900 | Second Topline Arc |
| Radius Length in mm=5.9436$x$+133.2500 | First Sole Arc |
| Radius Length in mm=8.5344$x$+190.6000 | Second Sole Arc. |

14. The shoe of claim 9 wherein said first sole arc defines an angle of approximately 41°, said angle being measured from a center of a first sole circle, having its center located on a sole reference axis, which is normal to a plane tangential to a sole curve transition point between said first sole arc and said second sole arc, said reference axis positioned at the same longitudinal position as said sole curve transition point and substantially laterally centered within said shoe, to a point of intersection between a circumference of said first sole circle and a front-most portion of said first sole arc;

wherein said second sole arc defines an angle of approximately 30°, said angle being measured from a center of a second sole circle, having its center located on the sole reference axis, to a point of intersection between a circumference of said second sole circle and a rear-most portion of said second sole arc; and wherein the angles of said first sole arc and said second sole arc, with respect to said reference axis, are kept constant across various shoe sizes, but the radii of the circles from which said arcs are taken are adjusted substantially in accordance with the following equations, where "x" indicates women's US shoe size:

$$\text{Radius Length in mm} = 5.9436x + 133.2500 \qquad \text{First Sole Arc}$$

$$\text{Radius Length in mm} = 8.5344x + 190.600 \qquad \text{Second Sole Arc.}$$

* * * * *